US006122790A

United States Patent [19]

Wambeke

[11] Patent Number: 6,122,790

[45] Date of Patent: Sep. 26, 2000

[54] TUBE END AND FITTING PREPARATION TOOL

[76] Inventor: James R. Wambeke, 503 E. 5th St., Minneota, Minn. 56264

[21] Appl. No.: 09/224,320

[22] Filed: Dec. 31, 1998

Related U.S. Application Data

[63] Continuation-in-part of application No. 08/863,823, May 27, 1997, abandoned.

[51] Int. Cl.[7] ..... B08B 9/02

[52] U.S. Cl. ..... 15/88; 15/104.04; 15/104.05; 15/104.095

[58] Field of Search ..... 15/88, 88.2, 88.3, 15/77, 104.03, 104.04, 104.05, 104.095

[56] References Cited

U.S. PATENT DOCUMENTS

| | | | |
|---|---|---|---|
| 2,225,200 | 12/1940 | Ames . | |
| 2,793,473 | 5/1957 | Hickman . | |
| 3,000,026 | 9/1961 | Prins et al. . | |
| 3,027,688 | 4/1962 | Zabransky . | |
| 3,067,443 | 12/1962 | Romens et al. . | |
| 3,134,202 | 5/1964 | Hoefler . | |
| 4,791,693 | 12/1988 | Kvaternik . | |
| 5,099,537 | 3/1992 | Denny . | |
| 5,156,634 | 10/1992 | Yang . | |
| 5,269,104 | 12/1993 | Dibiagi . | |
| 5,315,729 | 5/1994 | Yang . | |
| 5,493,748 | 2/1996 | Santo | 15/104.095 |

FOREIGN PATENT DOCUMENTS

| | | |
|---|---|---|
| 319993 | of 0000 | France . |
| 35 35 806 A1 | 4/1987 | Germany . |

*Primary Examiner*—Randall E. Chin

[57] ABSTRACT

A tube and fitting preparation tool is provided including a base and at least one shaft rotatably coupled to the base. A motor is in communication with the shaft for rotating the same. Mounted on a first end of the shaft is a male brush while a female brush is mounted on a second end of the shaft.

22 Claims, 5 Drawing Sheets

TUBE END AND FITTING PREPARATION TOOL

RELATED APPLICATION

The present application is a continuation-in-part application of a parent application filed May 27, 1997 under Ser. No. 08/863,823, now abandoned and which is incorporated herein by reference.

BACKGROUND OF THE INVENTION

1. Field of the Invention

The present invention relates to brush assemblies and more particularly pertains to a new tube and fitting preparation tool for cleaning a tube or fitting in preparation of connecting the same.

2. Description of the Prior Art

The use of brush assemblies is known in the prior art. More specifically, brush assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,426,807; 5,493,748; 5,413,133; 5,295,278; 5,235,718; and 5,184,637; 5,168,593; 5,155,883; 4,872,232; 4,860,821; 4,836,702; 4,734,952; 4,546,519; 4,406,031; 4,269,264; 4,204,292; 4,184,222; 3,604,040; D356,213; D510,278; 5,099,537.

In these respects, the tube and fitting preparation tool according to the present invention substantially departs from the conventional concepts and designs of the prior art, and in so doing provides an apparatus primarily developed for the purpose of cleaning a tube or fitting in preparation of connecting the same.

SUMMARY OF THE INVENTION

In view of the foregoing disadvantages inherent in the known types of brush assemblies now present in the prior art, the present invention provides a new tube and fitting preparation tool construction wherein the same can be utilized for cleaning a tube or fitting in preparation of connecting the same.

The general purpose of the present invention, which will be described subsequently in greater detail, is to provide a new tube and fitting preparation tool apparatus and method which has many of the advantages of the brush assemblies mentioned heretofore and many novel features that result in a new tube and fitting preparation tool which is not anticipated, rendered obvious, suggested, or even implied by any of the prior art brush assemblies, either alone or in any combination thereof.

To attain this, the present invention generally comprises a base having a bottom plate with a substantially planar rectangular configuration. Such bottom plate is equipped with a periphery defined by a pair of elongated side edges and a pair of short end edges. As shown in the Figures, a bottom face of the bottom plate of the base has a plurality of substantially disk-shaped pads mounted thereon at each of the corners thereof. The base further includes an end wall with a substantially planar square configuration integrally coupled to the bottom plate of the base along one of the end edges thereof. Such end wall extends upwardly from the bottom plate in perpendicular relationship therewith and is further defined by a pair of vertical side edges and a horizontal top edge with a pair of beveled intermediate edges therebetween. Associated therewith is an intermediate wall with a size and shape similar to that of the end wall. The intermediate wall, however, is integrally coupled to the bottom plate of the base between the side edges of the base and further between the end wall and a center of the bottom plate of the base. For reasons that will soon become apparent, a pair of substantially triangular apertured tabs are integrally coupled between the side edges of the bottom plate of the base and the side edges of the end wall. Also included is a pair of substantially rectangular apertured tabs integrally coupled to the side edges of the bottom plate opposite the triangular apertured tabs. Next provided is a plurality of linear shafts each rotatably coupled within bores formed in the end wall and the intermediate wall of the base. The shafts preferably reside in parallel relationship with the bottom plate of the base. Further, the shafts are positioned adjacent to the side edges of the end and intermediate walls and adjacent to top and bottom ends thereof, as shown in FIGS. 3–5. In the preferred embodiment, the shafts each have a first end with a substantially cylindrical chuck coupled thereto and positioned on an exterior surface of the end wall. A second end of each shaft is positioned adjacent to and spaced from one of the end edges of the bottom plate of the base. As shown in FIGS. 3 & 5, a disk-shaped gear is mounted on each shaft between the end wall and the intermediate wall. The disk-shaped gears are preferably oriented such that they remain in a single plane. As best shown in FIG. 1, a plurality of male attachments include a plurality of male brush attachments each having a linear rod for being removably coupled within the chuck of one of the shafts. Such rod of the male brush attachments each have a plurality bristles attached thereto which extend radially therefrom a unique predetermined distance. The male attachments further include a male auxiliary attachment including a linear rod for being removably coupled within the chuck of one of the shafts, in a manner similar to that of the male attachments. Four rigid substantially planar triangular plates are fixedly coupled to the shaft and extend outwardly therefrom at 90 degree increments. Also included is a plurality of female attachments. As shown in FIGS. 2 & 4, the female attachments include a plurality of female brush attachments each having a first end with a socket adapted for removably securing to the second end of one of the shafts. A second end of each of the female brush attachments include a cylindrical casing having a plurality of bristles attached to an inner surface thereof and extending inwardly therefrom a unique predetermined distance. For reasons that will soon become apparent, the second end of the female brush attachments reside flush with one of the end edges of the bottom plate of the base. The female attachments further include a female auxiliary attachment having a first end with a socket adapted for removably securing to the second end of one of the shafts. A second end of the female auxiliary attachment includes a cylindrical casing having four rigid substantially planar triangular plates fixedly coupled to an inner surface thereof extending inwardly therefrom at 90 degree increments. Similar to the female brush attachments, the second end of the female auxiliary attachment resides flush with one of the end edges of the bottom plate of the base. A motor is provided having a stator coupled to a central extent of the intermediate wall of the base and extending therefrom away from the end wall of the base. Ideally, the motor resides between each of the shafts in parallel relationship therewith. FIGS. 3 & 5 show that the motor further includes a rotor extending between the intermediate wall and the end wall of the base with a disk-shaped gear mounted thereon in coplanar relationship with the disk-shaped gears of the shafts. Next provided is a chain engaging an outer surface of the disk-shaped gears of each of the shafts and a lower surface of the disk-shaped gear of the motor. The chain thus functions for rotating the shafts upon the actuation of the motor. FIGS. 1 & 2 depict a cover including a top wall with an inverted U-shaped handle mounted thereon. The cover is further defined by a pair of upper beveled walls and a pair of side walls each having a lower edges equipped with bores for being screwably attached to the apertured tabs of the base. As shown in FIG. 2, an edge of each of the walls of the cover has an inwardly extending lip which defines an open end. For being removably positioned within the open end of the cover, a removable barrier is provided with a substantially planar square configuration. The barrier is defined by a horizontal bottom edge, a pair of vertical side edges, and a horizontal top edge with a pair of beveled intermediate edges therebetween. In use, the barrier is removably attached to the open end of the cover and has a plurality of large bores formed therein for allowing access to the second ends of the female attachments. Finally, a push button momentary switch is positioned on the top wall of the cover and connected between a power source and the motor for selectively actuating the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tube and fitting preparation tool apparatus and method which has many of the advantages of the brush assemblies mentioned heretofore and many novel features that result in a new tube and fitting preparation tool which is not anticipated, rendered obvious, suggested, or even implied by any of the prior art brush assemblies, either alone or in any combination thereof.

It is another object of the present invention to provide a new tube and fitting preparation tool which may be easily and efficiently manufactured and marketed.

It is a further object of the present invention to provide a new tube and fitting preparation tool which is of a durable and reliable construction.

An even further object of the present invention is to provide a new tube and fitting preparation tool which is susceptible of a low cost of manufacture with regard to both materials and labor, and which accordingly is then susceptible of low prices of sale to the consuming public, thereby making such tube and fitting preparation tool economically available to the buying public.

Still yet another object of the present invention is to provide a new tube and fitting preparation tool which provides in the apparatuses and methods of the prior art some of the advantages thereof, while simultaneously overcoming some of the disadvantages normally associated therewith.

Still another object of the present invention is to provide a new tube and fitting preparation tool for cleaning a tube or fitting in preparation of connecting the same.

Even still another object of the present invention is to provide a new tube and fitting preparation tool that includes a base and at least one shaft rotatably coupled to the base. A motor is in communication with the shaft for rotating the same. Mounted on a first end of the shaft is a male brush while a female brush is mounted on a second end of the shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
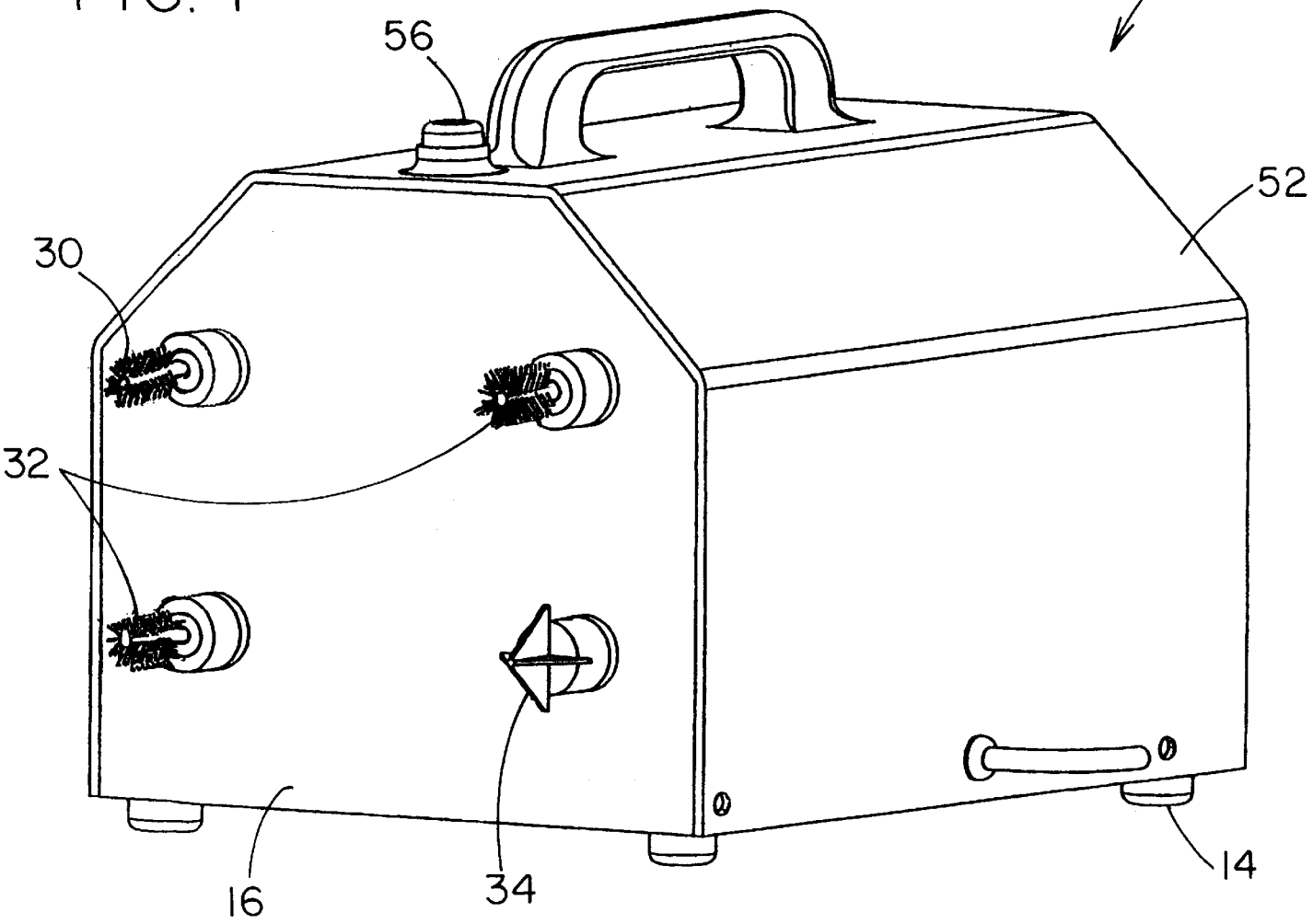
FIG. 1 is a front perspective view of a new tube and fitting preparation tool according to the present invention.

With reference now to the drawings, and in particular to FIGS. 1 through 5 thereof, a new tube and fitting preparation tool embodying the principles and concepts of the present invention and generally designated by the reference numeral 10 will be described.

The present invention, designated as numeral 10, includes a base having a bottom plate 12 with a substantially planar rectangular configuration. Such bottom plate is further equipped with a periphery defined by a pair of elongated side edges and a pair of short end edges. As shown in the Figures, a bottom face of the bottom plate of the base has a plurality of substantially disk-shaped pads 14 mounted thereon at each of the corners thereof. The base further includes an end wall 16 with a substantially planar square configuration integrally coupled to the bottom plate of the base along one of the end edges thereof. Such end wall extends upwardly from the bottom plate in perpendicular relationship therewith and is further defined by a pair of vertical side edges and a horizontal top edge with a pair of beveled intermediate edges therebetween. Associated therewith is an intermediate wall 18 with a size and shape similar to that of the end wall. The intermediate wall, however, is integrally coupled to the bottom plate of the base between the side edges of the base and further between the end wall and a center of the bottom plate of the base. For reasons that will soon become apparent, a pair of substantially triangular apertured tabs 20 are integrally coupled between the side edges of the bottom plate of the base and the side edges of the end wall. Also included is a pair of substantially rectangular apertured tabs 22 integrally coupled to the side edges of the bottom plate opposite the triangular apertured tabs.

Figure 3:
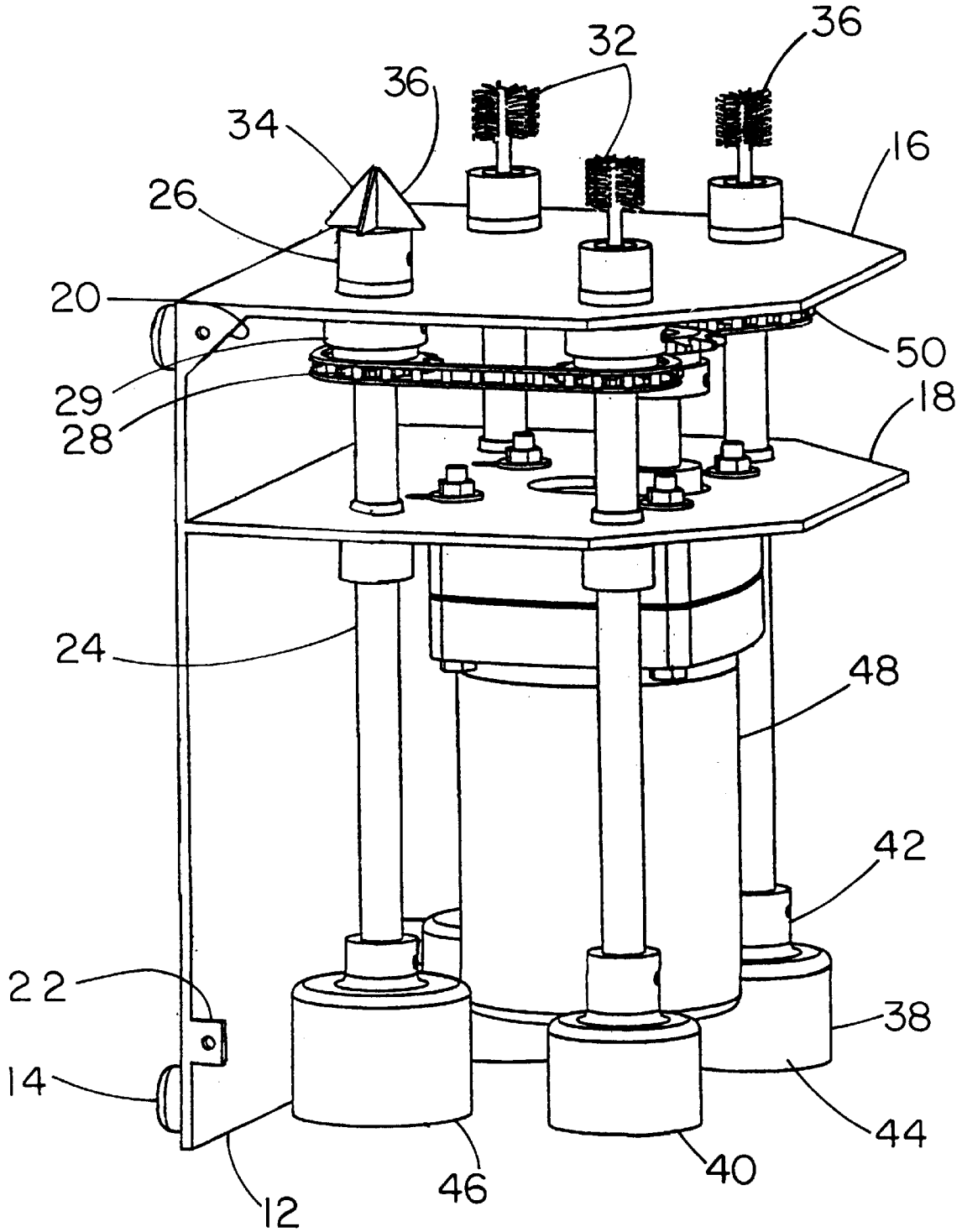
FIG. 3 is a front perspective view of the present invention with the cover removed.
Figure 4:
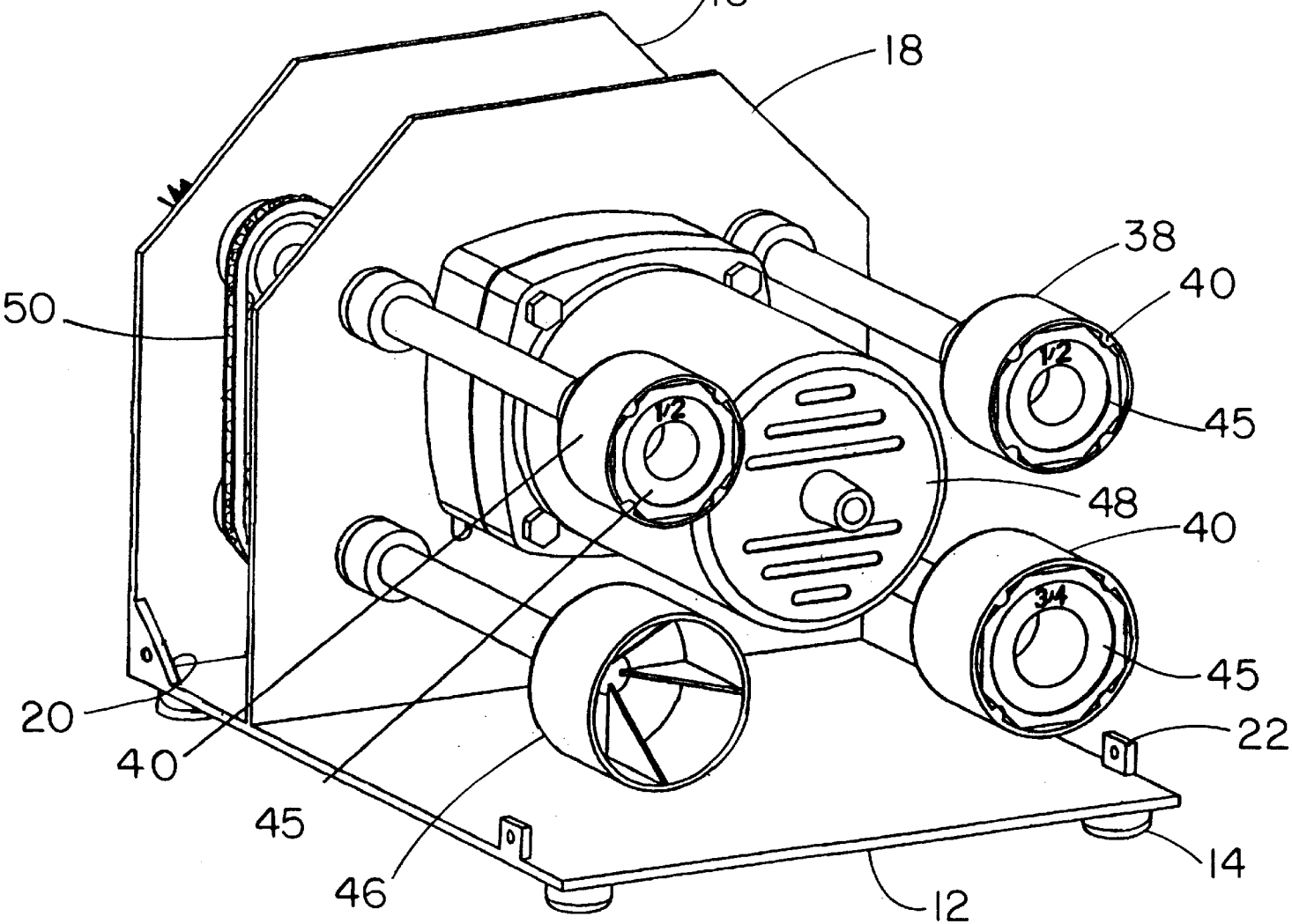
FIG. 4 is a rear perspective view of the present invention with the cover removed.
Figure 5:
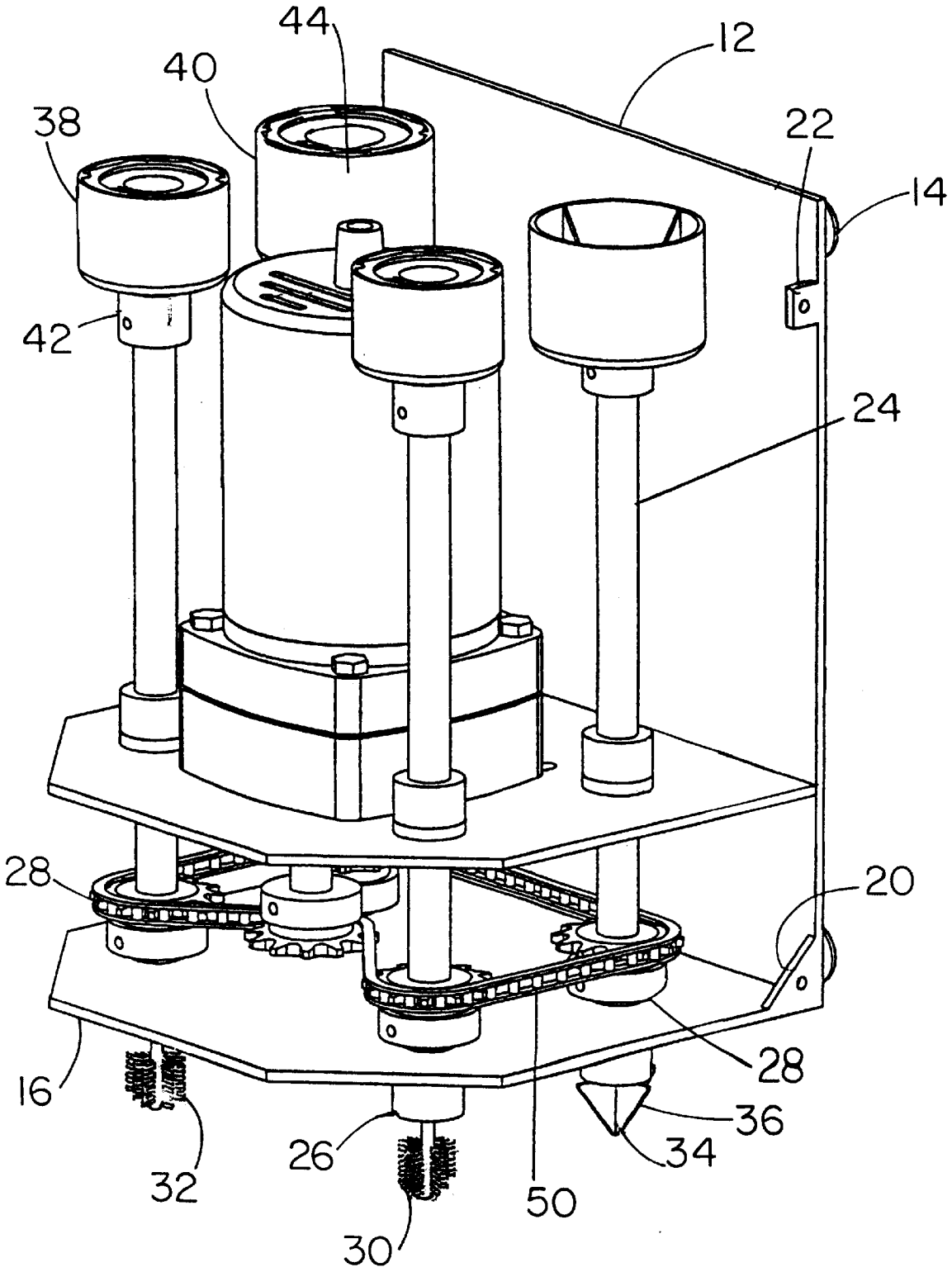
FIG. 5 is a side view of the present invention.

Next provided is a plurality of linear shafts 24 each rotatably coupled within bores formed in the end wall and the intermediate wall of the base. The shafts preferably reside in parallel relationship with the bottom plate of the base. Further, the shafts are positioned adjacent to the side edges of the end and intermediate walls and adjacent to top and bottom ends thereof, as shown in FIGS. 3–5. In the preferred embodiment, the shafts each have a first end with a substantially cylindrical chuck 26 coupled thereto and positioned on an exterior surface of the end wall. A second end of each shaft is positioned adjacent to and spaced from one of the end edges of the bottom plate of the base. As shown in FIGS. 3 & 5, a disk-shaped gear 28 is mounted on each shaft between the end wall and the intermediate wall. The disk-shaped gears are preferably oriented such that they remain in a single plane. As shown in the Figures, each disk-shaped gear has an annular bracket 29 fixed thereto in coaxial relationship therewith for being attached to the associated shaft via a set screw or the like.

As best shown in FIG. 1, a plurality of male attachments 30 include a plurality of male brush attachments 32 each having a linear rod for being removably coupled within the chuck of one of the shafts. This is preferably accomplished by the insertion of the rod within the chuck and the tightening of a set screw or the like. Such rod of the male brush attachments further each has a plurality bristles attached thereto which extend radially therefrom a unique predetermined distance. The male attachments also include a male auxiliary attachment 34 including a linear rod for being removably coupled within the chuck of one of the shafts in a manner similar to that of the male attachments. Four rigid substantially planar triangular plates 36 are fixedly coupled to the shaft and extend outwardly therefrom at 90 degree increments.

Figure 2:
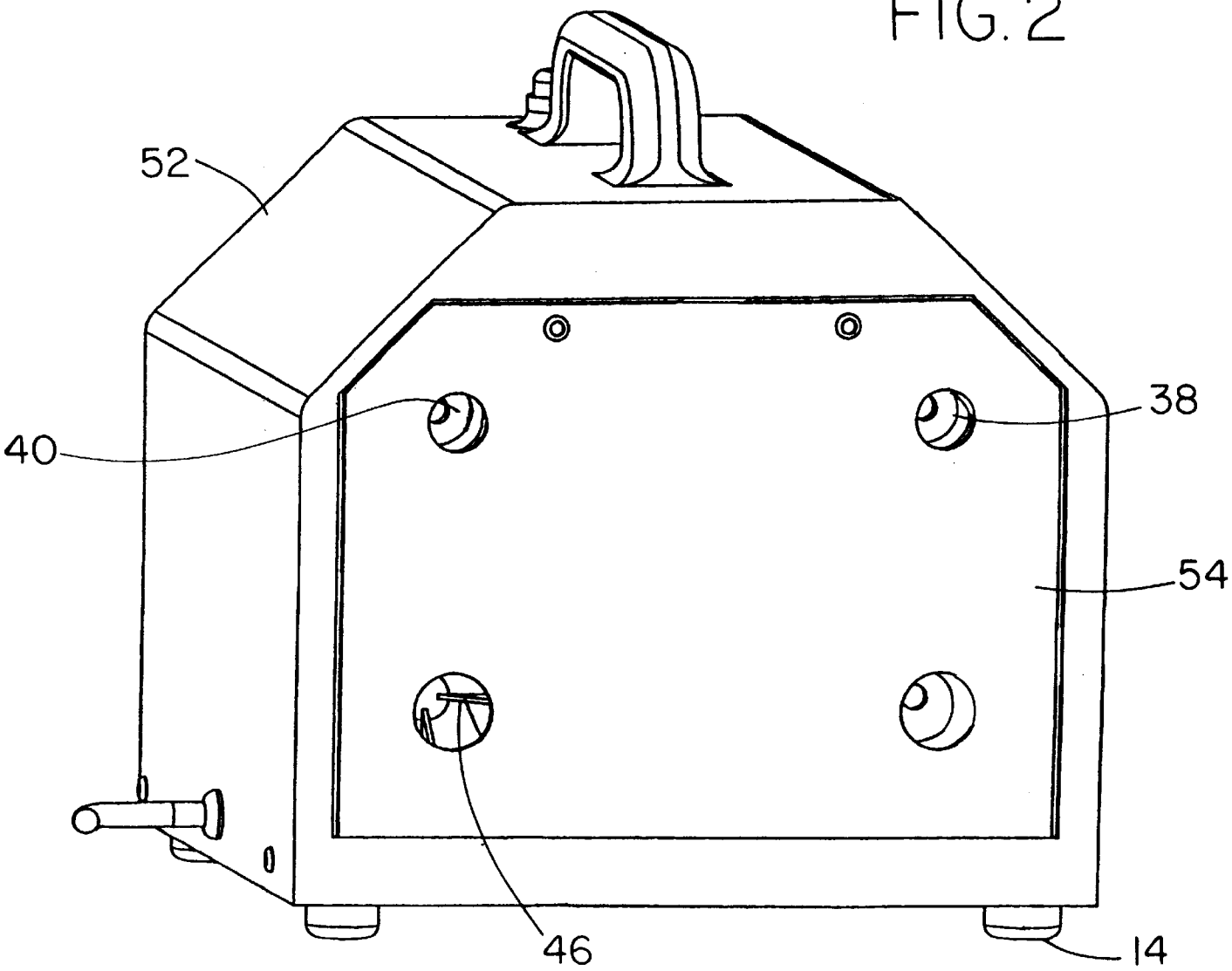
FIG. 2 is a rear perspective view of the present invention.

Also included is a plurality of female attachments 38. As shown in FIGS. 2 & 4, the female attachments include a plurality of female brush attachments 40 each having a first end with a socket 42 adapted for removably securing to the second end of one of the shafts. This is preferably accomplished by the insertion of the second end of one of the shafts within the socket and securement via a set screw. A second end of each of the female brush attachments include a cylindrical casing 44 having a plurality of bristles attached to an inner surface thereof and extending inwardly therefrom a unique predetermined distance. Ideally, an outer peripheral edge of the casing of each female brush attachment has an inwardly extending annular flange 45. For reasons that will soon become apparent, the second end of the female brush attachments reside flush with one of the end edges of the bottom plate of the base. The female attachments further include a female auxiliary attachment 46 having a first end with a socket adapted for removably securing to the second end of one of the shafts. A second end of the female auxiliary attachment includes a cylindrical casing having four rigid substantially planar triangular plates fixedly coupled to an inner surface thereof extending inwardly therefrom at 90 degree increments. Similar to the female brush attachments, the second end of the female auxiliary attachment resides flush with one of the end edges of the bottom plate of the base.

A motor 48 is provided having a stator coupled to a central extent of the intermediate wall of the base and extending therefrom away from the end wall of the base. Ideally, the motor resides between each of the shafts in parallel relationship therewith. FIGS. 3 & 5 show that the motor further includes a rotor extending between the intermediate wall and the end wall of the base with a disk-shaped gear mounted thereon in coplanar relationship with the disk-shaped gears of the shafts.

Next provided is a chain 50 engaging an outer surface of the disk-shaped gears of each of the shafts and a lower surface of the disk-shaped gear of the motor. The chain thus functions for rotating the shafts upon the actuation of the motor.

FIGS. 1 & 2 depict a cover 52 including a top wall with an inverted U-shaped handle mounted thereon. The cover is further defined by a pair of upper beveled walls and a pair of side walls each having a lower edges equipped with bores for being screwably attached to the apertured tabs of the base. As shown in FIG. 2, an edge of each of the walls of the cover has an inwardly extending lip which defines an open end.

For being removably positioned within the open end of the cover, a removable barrier 54 is provided with a substantially planar square configuration. The barrier is defined by a horizontal bottom edge, a pair of vertical side edges, and a horizontal top edge with a pair of beveled intermediate edges therebetween. In use, the barrier is removably attached to the open end of the cover and has a plurality of large bores formed therein for allowing access to the second ends of the female attachments.

Finally, a push button momentary switch 56 is positioned on the top wall of the cover and connected between a power source and the motor for selectively actuating the motor.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tube and fitting preparation tool comprising, in combination:

a base including a bottom plate with a substantially planar rectangular configuration having a periphery defined by a pair of elongated side edges and a pair of short end edges, a bottom face of the bottom plate of the base having a plurality of substantially disk-shaped pads mounted thereon at each of the corners thereof, the base further including an end wall with a substantially planar square configuration integrally coupled to the bottom plate of the base along one of the end edges thereof and extending upwardly therefrom in perpendicular relationship therewith and defined by a pair of vertical side edges and a horizontal top edge with a pair of beveled intermediate edges therebetween, an intermediate wall with a substantially planar square configuration integrally coupled to the bottom plate of the base between the side edges of the base and extending upwardly therefrom in perpendicular relationship therewith between the end wall and a center of the bottom plate of the base with the intermediate wall defined by a pair of vertical side edges and a horizontal top edge with a pair of beveled intermediate edges therebetween, a pair of substantially triangular apertured tabs integrally coupled between the side edges of the bottom plate of the base and the side edges of the end wall, and a pair of substantially rectangular apertured tabs integrally coupled to the side edges of the bottom plate opposite the triangular apertured tabs and extending upwardly from the bottom plate of the base;

a plurality of linear shafts each rotatably coupled within bores formed in the end wall and the intermediate wall of the base in parallel relationship with the bottom plate of the base such that the shafts are positioned adjacent to the side edges of the end and intermediate walls and adjacent to top and bottom ends thereof, the shafts each having a first end with a substantially cylindrical chuck coupled thereto and positioned on an exterior surface of the end wall, a second end positioned adjacent to and spaced from one of the end edges of the bottom plate of the base, and a disk-shaped gear mounted thereon between the end wall and the intermediate wall such that the disk-shaped gears of the shafts remain in a single plane;

a plurality of male attachments including a plurality of male brush attachments each having a linear rod for being removably coupled within the chuck of one of the shafts and a plurality bristles attached thereto and extending radially therefrom a unique predetermined distance, the male attachments further including a male auxiliary attachment including a linear rod for being removably coupled within the chuck of one of the shafts and four rigid substantially planar triangular plates fixedly coupled to the shaft and extending outwardly therefrom at 90 degree increments;

a plurality of female attachments including a plurality of female brush attachments each having a first end with a socket adapted for removably securing to the second end of one of the shafts and a second end including a cylindrical casing having a plurality of bristles attached to an inner surface thereof and extending inwardly therefrom a unique predetermined distance with the second end of the female brush attachments residing flush with one of the end edges of the bottom plate of the base, the female attachments further including a female auxiliary attachment having a first end with a socket adapted for removably securing to the second end of one of the shafts and a second end including a cylindrical casing having four rigid substantially planar triangular plates fixedly coupled to an inner surface thereof extending inwardly therefrom at 90 degree increments with the second end of the female auxiliary attachment residing flush with one of the end edges of the bottom plate of the base;

a motor having a stator coupled to a central extent of the intermediate wall of the base and extending therefrom away from the end wall of the base between each of the shafts in parallel relationship therewith, the motor further including a rotor extending between the intermediate wall and the end wall of the base with a disk-shaped gear mounted thereon in coplanar relationship with the disk-shaped gears of the shafts;

a chain engaging an outer surface of the disk-shaped gears of each of the shafts and a lower surface of the disk-shaped gear of the motor for rotating the shafts upon the actuation of the motor;

a cover including a top wall with an inverted U-shaped handle mounted thereon, a pair of upper beveled walls and a pair of side walls each having a lower edges equipped with bores for being screwably attached to the apertured tabs of the base, wherein an edge of each of the walls of the cover has an inwardly extending lip which defines an open end;

a removable barrier with a substantially planar square configuration defined by a horizontal bottom edge, a pair of vertical side edges, and a horizontal top edge with a pair of beveled intermediate edges therebetween, wherein the barrier is removably attached to the open end of the cover and has a plurality of large bores formed therein for allowing access to the second ends of the female attachments; and a push button momentary switch positioned on the top wall of the cover and connected between a power source and the motor for selectively actuating the motor.

2. A tube and fitting preparation tool comprising:

a base;

at least one shaft rotatably coupled to the base;

a motor in communication with the shaft for rotating the same;

a male brush implement mounted on a first end of the shaft; and a female brush implement mounted on a second end of the shaft;

wherein the base includes a removable barrier with a plurality of bores for allowing access to the female brush implement.

3. A tube and fitting preparation tool as set forth in claim 2 wherein the base includes a removable cover.

4. A tube and fitting preparation tool as set forth in claim 2 wherein a plurality of shafts are included each with a gear that is engaged with a gear of the motor via a chain.

5. A tube and fitting preparation tool as set forth in claim 2 wherein at least one of the implements is removable.

6. A tube and fitting preparation tool as set forth in claim 2 wherein the female brush implement includes a cylindrical casing with a plurality of bristles coupled to an inner surface thereof and extending inwardly therefrom.

7. A tube and fitting preparation tool as set forth in claim 2 additionally comprising an implement having a plurality of rigid substantially planar triangular plates which are positioned at 90 degree increments.

8. A tube and fitting preparation tool comprising:

a base;

at least one shaft rotatably coupled to the base;

a motor in communication with the shaft for rotating the shaft;

a male brush implement mounted on a first end of the shaft; and a female brush implement mounted on a second end of the shaft;

wherein a plurality of shafts are included each with a gear that is engaged with a gear of the motor via a chain.

9. A tube and fitting preparation tool as set forth in claim 8 wherein the base includes a removable barrier with a plurality of bores for allowing access to the female brush implement.

10. A tube and fitting preparation tool as set forth in claim 8 wherein the base includes a removable cover.

11. A tube and fitting preparation tool as set forth in claim 8 wherein at least one of the implements is removable.

12. A tube and fitting preparation tool as set forth in claim 8 wherein the female brush implement includes a cylindrical casing with a plurality of bristles coupled to an inner surface thereof and extending inwardly therefrom.

13. A tube and fitting preparation tool as set forth in claim 8 additionally comprising an implement having a plurality of rigid substantially planar triangular plates which are positioned at 90 degree increments.

14. A tube and fitting preparation tool comprising:

a base;

at least one shaft rotatably coupled to the base;

a motor in communication with the shaft for rotating the shaft;

a male brush implement mounted on a first end of the shaft;

a female brush implement mounted on a second end of the shaft; and additionally comprising an implement having a plurality of rigid substantially planar triangular plates which are positioned at 90 degree increments.

15. A tube and fitting preparation tool as set forth in claim 14 wherein the base includes a removable cover.

16. A tube and fitting preparation tool as set forth in claim 14 wherein at least one of the implements is removable.

17. A tube and fitting preparation tool as set forth in claim 14 wherein the female brush implement includes a cylindrical casing with a plurality of bristles coupled to an inner surface thereof and extending inwardly therefrom.

18. A tube and fitting preparation tool comprising:

a base;

a plurality of shafts rotatably mounted on the base;

a motor operatively coupled to the plurality of shafts for rotating the shafts;

a male brush implement mounted on first ends of each of the plurality of shafts; and a female brush implement mounted on second ends of each of the plurality of shafts;

wherein each of the male brush implements has a plurality of bristles, the plurality of bristles defining an outer radius size for the implement, the outer radius size of the bristles of one of the male brush implements being different from the outer radius size of the bristles of another of the male brush implements, and wherein each of the female brush implements has a plurality of bristles, the plurality of bristles defining an inner radius size for the implement, the inner radius size of the bristles of one of the female brush implements being different from the inner radius size of the bristles of another of the female brush implements.

19. A tube and fitting preparation tool as set forth in claim 18 wherein at least one of the implements is removably mounted on the respective shaft.

20. A tube and fitting preparation tool as set forth in claim 18 wherein each of the female brush implements includes a casing, and a plurality of bristles coupled to an inner surface of the casing and extending inwardly therefrom.

21. A tube and fitting preparation tool as set forth in claim 18 additionally comprising an implement having a plurality of rigid plates mounted on a casing and extending radially inward.

22. A tube and fitting preparation tool as set forth in claim 18 additionally comprising an implement having a plurality of rigid plates extending radially outward from a central point.

* * * * *